US005433662A

United States Patent [19]

Hungerford

[11] Patent Number: 5,433,662

[45] Date of Patent: Jul. 18, 1995

[54] AIR BAR

[76] Inventor: John W. Hungerford, P.O. Box 631350, Nacogdoches, Tex. 75963

[21] Appl. No.: 217,954

[22] Filed: Mar. 25, 1994

[51] Int. Cl.[6] ..... F24F 13/072

[52] U.S. Cl. ..... 454/303

[58] Field of Search ..... 454/301, 303, 304

[56] References Cited

U.S. PATENT DOCUMENTS

| | | | |
|---|---|---|---|
| 3,099,949 | 8/1963 | Davidson . | |
| 3,126,811 | 3/1964 | Kennedy | 454/304 |
| 3,127,827 | 4/1964 | Ericson | 454/303 |
| 3,132,579 | 5/1964 | La Vigne et al. | 454/303 |
| 3,183,821 | 5/1965 | Averill et al. . | |
| 3,202,077 | 8/1964 | Lee | 454/301 |
| 3,207,057 | 9/1965 | Brown et al. | 454/301 |
| 3,276,348 | 10/1966 | Kennedy . | |
| 3,302,550 | 2/1967 | Thomson . | |
| 3,308,744 | 3/1967 | Schach | 454/304 |
| 3,411,425 | 11/1968 | Lambert | 454/303 |
| 3,444,801 | 5/1969 | Lambert | 454/303 |
| 3,601,033 | 8/1971 | Lambert . | |
| 3,760,709 | 9/1973 | Rachlin et al. . | |
| 3,919,928 | 11/1975 | Lambert . | |
| 4,316,407 | 2/1982 | Lambert . | |
| 4,869,157 | 9/1989 | Hungerford | 454/303 |
| 5,001,967 | 3/1991 | Hungerford | 454/303 X |
| 5,215,284 | 6/1993 | Hungerford | 454/301 X |

FOREIGN PATENT DOCUMENTS

| | | |
|---|---|---|
| 2518609 | 11/1976 | Germany . |
| 1361077 | 7/1974 | United Kingdom . |

*Primary Examiner*—Harold Joyce
*Attorney, Agent, or Firm*—Randall C. Brown

[57] ABSTRACT

An air bar for mounting in the ceiling system of a structure. The air bar is characterized by a pair of inwardly facing, angled and spaced air deflectors fitted with horizontally shaped top and bottom spacers at each end thereof. A barbell shaped pattern controller is laterally slidably mounted between the spacers and extends substantially throughout the length of the air deflectors, to deflect air flowing through the air bar and directionally distribute the air through an air slot between the air deflectors, into the structure.

13 Claims, 3 Drawing Sheets

AIR BAR

BACKGROUND OF THE INVENTION

1. Field of the Invention

The present invention relates to linear air slot diffusers and more particularly to a self-supporting linear air bar which serves to diffuse air in a selected pattern from the ceiling plenum of a structure or from a vertical or angular wall.

2. Description of the Prior Art

The use of suspended ceilings which extend downwardly from a permanent ceiling of a building has become widespread, and aesthetic considerations require that lighting fixtures, air conditioning outlets, and other similar equipment and accessories be flush-mounted with the suspended ceiling. The space between the suspended and permanent ceiling is known a "plenum" and usually receives air conditioning ducts, cables, piping, and other similar equipment.

Many conventional air bars for distributing air in connection with suspended ceilings suffer from several common disadvantages. Some are suspended by wires which hang from building structures at predetermined locations. Often, the structure of the building requires that the original location of the suspension wires be abandoned for a more structurally convenient location. Often the new location of the suspension wires differs from the hanger connection of the air bar necessitating reassembly of the air bar to accommodate the new suspension wire location. This procedure complicates the installation of the air bar making assembly difficult and resulting in high labor cost and loss of time.

Another disadvantage associated with conventional air bars involves the use of curved or arcuate air deflectors. Because of the curved or arcuate configuration, the aluminum extrusion has some portions thicker than others which causes the aluminum to cool differently causing some distortion. Also, it is difficult to maintain flatness at the flanges.

Still another disadvantage associated with conventional air bars involves the use of several generally flat pattern controllers nested between an upper and a lower spacer. The position of the nested pattern controller causes it to bind between the spacers making any post installation adjustments of the controller difficult, if not impossible.

A still further disadvantage associated with the nested pattern controller is its tendency to rattle when air enters the distribution system. In an effort to resolve this problem, some air bar manufacturers designed the pattern controller so that its profile would be bowed rather than planar to help secure the pattern controller between the upper and lower spacers. However, the bow in the pattern controller often interfered with post-installation movement of the pattern controller. The bow in the pattern controller also caused it to bind on one side of the air distribution system and not on the other, resulting in even more rattling. If the installer exerted downward hand pressure on the pattern controllers during installation, which, while inadvertent, is commonplace, the downward pressure would remove the bow causing lack of adjustment and rattling of the pattern controllers.

A still further disadvantage with conventional air bars is that they are not capable of being architecturally integrated with other systems in the ceiling.

A still further disadvantage with conventional air bars is that they do not function structurally to support ceiling systems.

SUMMARY OF THE INVENTION

The air bar of the present invention overcomes the above-mentioned disadvantages and drawbacks which are characteristic of the prior art.

Specifically, the air deflectors of the air bar of the present invention do not include any curved or arcuate portions, thus ensuring that the deflectors have a uniform thickness. The air deflectors of the air bar of the present invention are as effective in terms of air movement as are curved or arcuate air deflectors.

Also, the air bar of the present invention weighs approximately 25% less than conventional air bars thus reducing the raw material cost of the air bars. The air bar of the present invention is reduced in height compared to conventional air bars and has a single pattern controller rather than a pair of nested pattern controllers, both of which factors make the air bar of the present invention easier to manufacture and easier to install, thereby reducing overall costs.

Moreover, the air bar of the present invention has better structural characteristics than conventional air bars. Indeed, the air bar of the present invention may function as a structural product to support a ceiling system.

Furthermore, the air bar of the present invention may be connected by an extensive system of clips such as shown in U.S. Pat. No. 5,215,284, the entire disclosure of which is incorporated herein by reference, which yield a truer and straighter installation in hard ceilings and which reduce labor costs for assembling the air bars. The system of clips also allows for attachment of air bars in any orientation, including perpendicular, as well as attachment of end products without welding. Moreover, the system of clips allows for sections of the air bars to be prefabricated prior to installation in a building structure. Also, the air bar of the present invention is supported by an improved hanger clip for lay-in ceilings which meet seismic requirements that conventional hanger clips do not meet.

Still further, the air bar of the present invention includes a single pattern controller that has a generally barbell shaped cross section and has reduced friction when compared to conventional air bars which include nested pattern controllers. After installation, the pattern controller of the present invention is easy to adjust through the air bar slot.

One embodiment of the air bar of the present invention allows for installation such that the flanges which define the air slot are not visible from below the air bar.

In another embodiment of the air bar of the present invention, the air deflector is modified to support a pair of parallel air bars.

The various air deflectors of the air bars of the present invention can be mixed and matched to satisfy different architectural and mechanical goals.

The air bar of the present invention comprises a pair of spaced, inwardly-facing air deflectors that receive bottom and top spacers containing a laterally slidably mounted pattern controller for directing air through passages defined by the air deflectors and the pattern controller, respectively, into a structure in a selected direction and volume.

The pattern controller preferably has a barbell shaped cross-section with rounded bulbous portions on either side of the pattern controller so that each rounded bulbous portion contacts the top spacer and the bottom spacer at points along the respective lengths of the spacers which reduces friction, allowing the pattern controllers to be easily moved, yet remain rattle-free.

According to a preferred embodiment of the present invention, the air bar comprises a pair of air deflectors having vertical air channels therein, spaced by an air slot, a plurality of spaced apart spacers provided along the length of the air deflectors and a plurality of pattern controllers in which each pattern controller is laterally slidably mounted between a pair of the spacers for deflecting air flowing through the air bar across the air channels and through the air slot in a direction which is determined by the position of the pattern controller.

Numerous objects, features and advantages of the present invention will be readily apparent to those of ordinary skill in the art upon a reading of the following detailed description of presently preferred but nonetheless illustrative embodiments of the present invention when taken in conjunction with the accompanying drawings.

DESCRIPTION OF THE PREFERRED EMBODIMENTS

Figure 1:
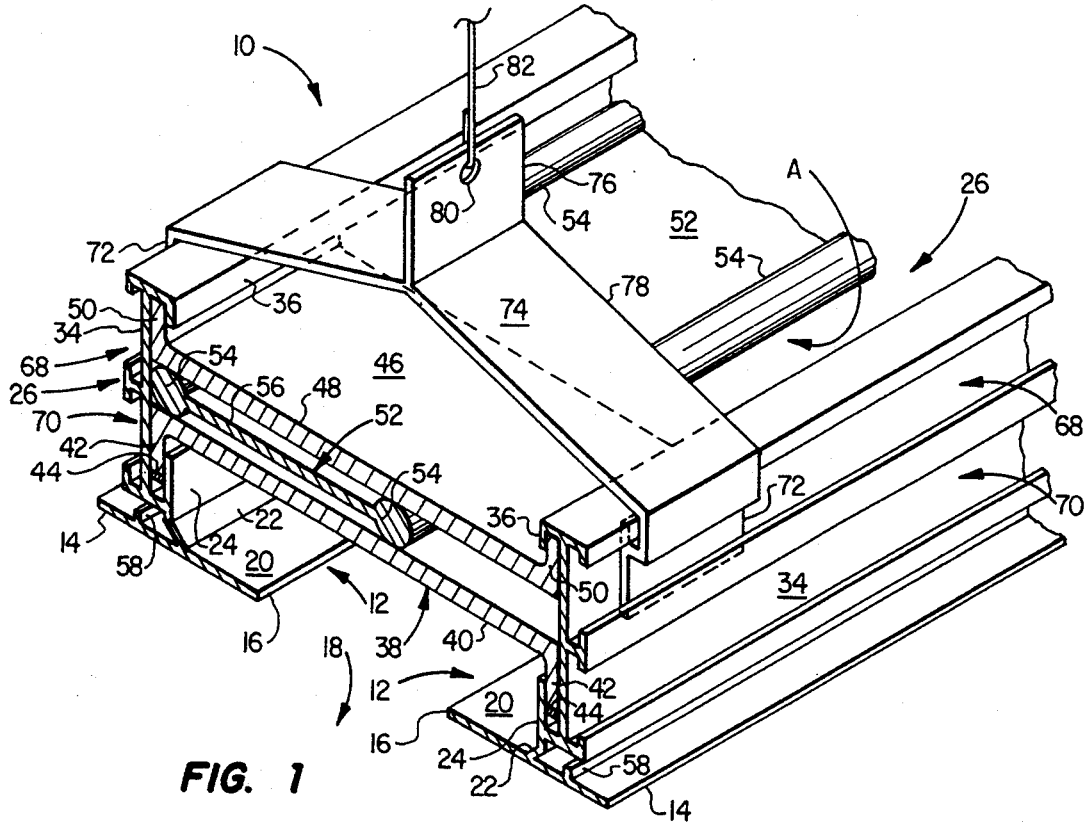
FIG. 1 is a perspective view in partial section of an air bar according to the present invention.

Referring now to the drawings, and particularly to FIG. 1, the air bar of the present invention is shown and generally designated by the reference numeral 10.

Figure 2:
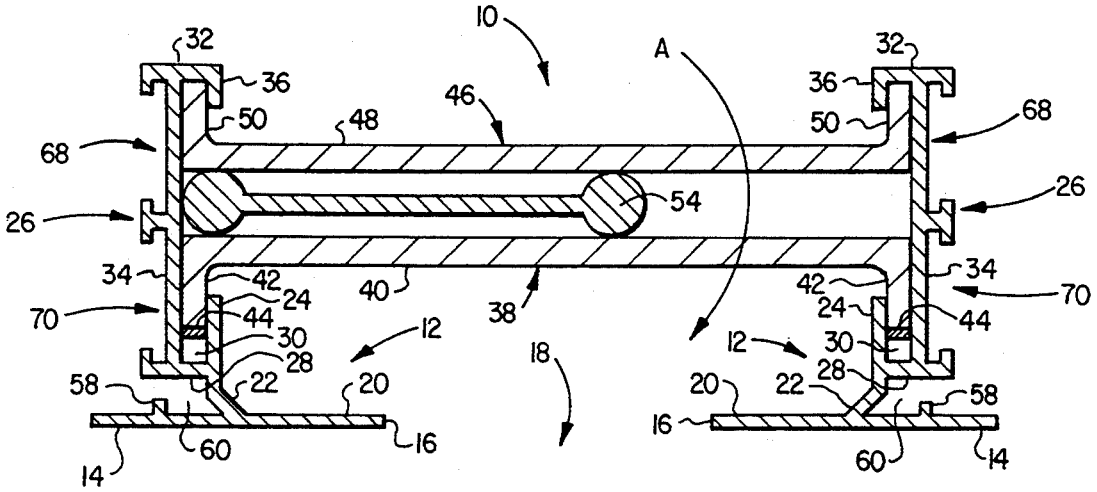
FIG. 2 is a cross-sectional view of the air bar illustrated in FIG. 1.

As shown in FIGS. 1 and 2, the air bar 10 includes a pair of oppositely disposed, inwardly facing deflectors 12, each fitted with a horizontally oriented outwardly extending deflector base 14.

Each deflector base 14 terminates along one edge in a base edge 16, which extends in parallel relationship with respect to the opposite base edge 16 to define an air slot 18.

Each deflector 12 further includes a horizontally oriented inwardly extending base 20, an angled section 22, and an upward standing shoulder 24 to define an angled air channel. The angled section 22 extends upwardly and outwardly from the base edge 20 and terminates in shoulder 24. Preferably, the angled section 22 extends at an obtuse angle, most preferably a 135° angle, with respect to the base edge 20. Preferably, the shoulder 24 extends at an obtuse angle, most preferably a 135° angle with respect to the angled section 22.

An I-beam 26 is formed on each deflector 12 extending outwardly from the shoulder 24. Each I-beam 26 includes a flange 28 extending inwardly towards the shoulder 24 to connect the I-beam 26 and the shoulder 24. Each I-beam 26 and the shoulders 24 define a bottom spacer seat 30. Each I-beam 26 includes a top spacer seat 32 located above and opposite the bottom spacer seat 30 and separated therefrom and connected thereto by the I-beam web 34. Each top spacer seat 32 includes a top spacer retainer 36 projecting downwardly from the top spacer seat 32.

A bottom spacer 38 extends transversely between the deflectors 12. The bottom spacer 38 includes a body 40 and oppositely disposed legs 42. The bottom spacer legs 42 are registered in a respective bottom spacer seat 30 of the deflectors 12. In a preferred embodiment of the air bar of the present invention, a spring clip 44 is disposed in each bottom spacer seat 30 to bias the bottom spacer legs 42 and thus the bottom spacer 38 in an upward direction for a purpose to be discussed below.

A top spacer 46 extends transversely between the deflectors 12. The top spacer 46 includes a body 48 and oppositely disposed legs 50. The top spacer legs 50 are registered in a respective top spacer seat 32 of the deflectors 12.

A pattern controller 52 extends transversely between the deflectors 12 and is slidably seated in the space between the bottom spacer 38 and the top spacer 46. The pattern controller 52 has a barbell-shaped cross-section with bulbous portions 54 at either end and a flattened body 56 extending between and connected to the bulbous portions 54 thereof. As shown in FIG. 2, the bulbous portions 54 of the pattern controller 52 contact the bottom spacer 38 and the top spacer 46 while the flattened body 56 of the pattern controller 52 is spaced apart from both the bottom spacer 38 and the top spacer 46. Also as shown in FIG. 2, the bulbous portions 54 have a substantially cylindrical cross-section.

It will be appreciated by those of ordinary skill in the art from a consideration of FIG. 2 that the pattern controller 52 is laterally slidably disposed in the space between the bottom spacer 38 and the top spacer 46 along the length of the deflectors 12. For instance, the pattern controller 52 can be manually slidably extended from the position shown in FIG. 2 in which the lefthand bulbous portion 54 engages the lefthand deflector 12 to a position in which the righthand bulbous portion 54 engages the righthand deflector 12. The variable positioning of the pattern controller 52 between the lefthand deflector 12 and the righthand deflector 12 allows a wide variety of air flow patterns emanating from the slot 18. For example, in the event that design conditions have been changed in the field that would result in drafty conditions, such drafty conditions can be avoided by slightly moving the pattern controller 52 away from either the lefthand or righthand deflector 12 so that air passes over and about the righthand and lefthand bulbous portions 54 of the pattern controller 52. This procedure reduces the velocity of the exiting airstream which reduces the distance the air flows beyond the air slot 18 and thereby eliminates such drafty conditions. Thus, the ability to alternate the position of the pattern controllers allows for infinite air flow adjustments for a draft-free environment.

It will also be appreciated by those of ordinary skill in the art that the entire length of the pattern controller 52 is not illustrated in FIG. 1, for purposes of clarity.

It will further be appreciated by those of ordinary skill in the art that the air deflectors 12 preferably are produced in lengths of 12 feet and the pattern controllers 52 and spacers 38 and 46 are disposed incrementally along the length of the air deflectors, preferably at 2 foot intervals. According to such an arrangement, air flow can be alternated from side to side along the length of the air slot 18.

The deflector base 14 includes a vertically extending flange 58. The deflector base 14, flange 58, flange 28, angled section 22 and shoulder 24 define an opening 60, the purpose of which is discussed below in connection with FIG. 6.

The spring clip 44 disposed in each bottom spacer seat 30 biases the bottom spacer 38 upwardly toward the pattern controller 52, which in turn biases the pattern controller 52 upwardly toward the top spacer 46, which in turn biases the top spacer 46 upwardly toward each top spacer seat 32, with the result that the pattern controller 52 is spring-loaded between the bottom spacer 38 and the top spacer 46 to prevent inadvertent lateral slippage of the pattern controller.

As shown in FIGS. 1 and 2, upper C-shaped channels 68 and lower C-shaped channels 70 are formed on the I-beams 26 extending opposite and opening away from the top spacer seat 32 and the bottom spacer seat 30.

Figure 5:
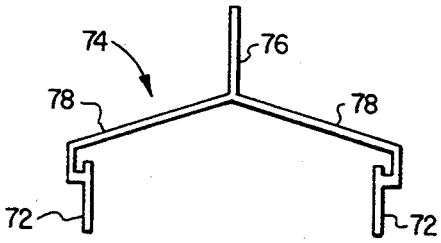
FIG. 5 is a front view of a hanger attachment for supporting the air bar of the present invention.

The upper C-shaped channels 68 slidingly receive flanges 72 of hanger bracket 74. Hanger bracket 74 is more clearly shown in FIG. 5 and includes a boss 76 extending in a vertical direction from body 78. The boss 76 includes a hole 80 through which a hanger wire 82 may be passed. As is customary in the art of lay-in ceilings, hanger wire 82 may be attached to a structural member for supporting the air bar 10 in a vertical direction within a structure. It will be appreciated by those of ordinary skill in the art that by virtue of attaching the hanger bracket 74 to the upper C-shaped channels 68 of the air bar 10 rather than the top spacer 46, the air bar 10 can be vertically supported at any point along the length thereof rather than only at the location of the top spacer. This feature of the present invention greatly simplifies the procedures for installing the air bar 10 which in turn results in reduced labor costs associated with the installation.

The upper C-shaped channels 68 or the lower C-shaped channels 70 slidingly receive clips such as those disclosed in U.S. Pat. No. 5,215,284, for joining air bars 10 in hard ceilings.

Figure 6:
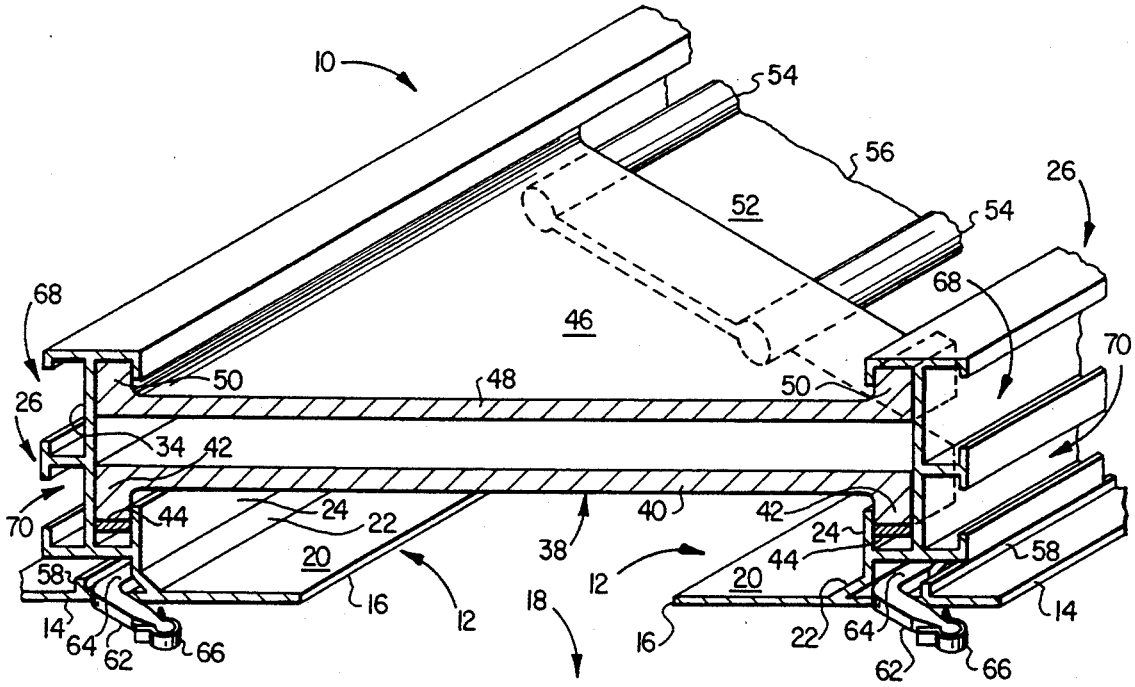
FIG. 6 is a perspective view in partial section of the air bar illustrated in FIG. 1, the end of which has been cut on a 45° angle.

As shown in FIG. 6, one end of the air bar 10 shown in FIG. 1 may be cut at a 45° angle and joined with another air bar (not shown) cut at a complementary 45° angle to form a mitred corner. As shown in FIG. 6, a first end 64 of a connector clip 62 may be inserted in opening 60 of the air bar 10 and the second end 66 may be inserted in a corresponding opening of the other air bar so as to connect the air bars and form a mitred corner. While not shown in the drawings, those of ordinary skill in the art will recognize that the connector clip 62 shown in FIG. 6 may be modified and the angle at which the end of the air bars are cut may be modified to allow for the connection of air bars according to the present invention in parallel relationship or at any desired angle, as well as a variety of end products.

Figure 3:
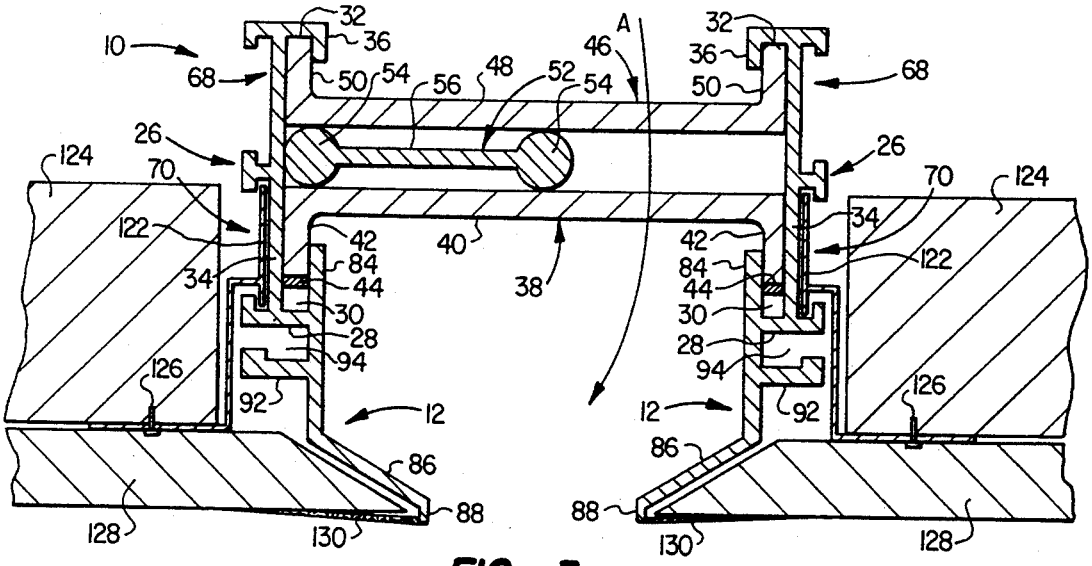
FIG. 3 is a cross-sectional view of an alternate embodiment of the air bar of the present invention.

In another preferred embodiment of the present invention and as shown in FIG. 3, the deflectors 12 include a modified and lengthened shoulder 84 and a modified and lengthened angled section 86 which extends inwardly and downwardly from the shoulder 84. The angled section 86 preferably extends at an obtuse angle, most preferably an angle of 135°, with respect to the shoulder 84. Each angled section 86 terminates at a vertical lip 88 with each shoulder 84, angled section 86 and vertical lip 88 defining an angled air channel. The respective vertical lips 88 are horizontally spaced apart in parallel relationship to each other and in parallel relationship to the shoulders 84 to define an airslot 90. A substantially horizontal L-shaped arm 92 extends from the shoulder 84 and is spaced from and parallel to the flange 28. The shoulder 84, L-shaped arm 92 and flange 28 form an opening 94 in which a connector clip such as connector clip 62 as shown in FIG. 6 may be inserted to connect a plurality of air bars in a variety of relationships.

AS shown in FIG. 3, this embodiment is preferably installed in a hard ceiling environment and can be used therein as a structural product to support a ceiling system. In this environment, the lower C-shaped channels 70 of the deflectors 12 are fitted with a hard ceiling clip 122 such as the clip disclosed in U.S. Pat. No. 5,215,284. The clip 122 is attached to and supported by framing 124. The clip 122 preferably is attached to framing 124 by a nail 126. Ceiling material 128 is then attached to the framing 124 and cut to fit flush with the angled section 86 and the lip 88 of the deflectors 12. Any gaps that exist between the ceiling material 128 and the angled section 86 or lip 88 of the deflectors 12 can be filled with suitable material 130 such as spackle or joint compound. According to the embodiment of the invention shown in FIG. 3, the angled sections 86 of the air deflectors 12 are not visible from below.

Figure 4:
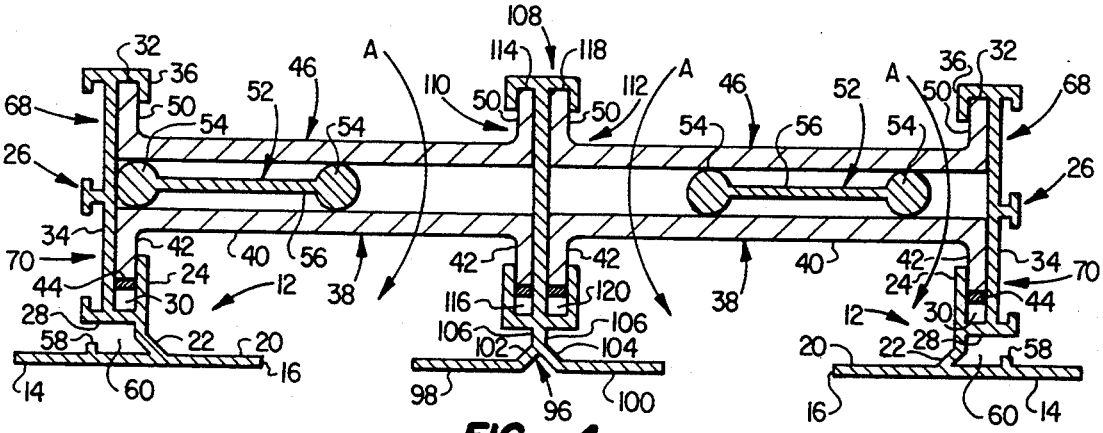
FIG. 4 is a cross-sectional view of an alternate embodiment of the air bar of the present invention.

Another preferred embodiment of the present invention is shown in FIG. 4 which includes a modified deflector 96 for receiving two sets of top spacers 46 and two sets of bottom spacers 38. On either side of the modified deflector 96 are deflectors 12 as described in connection with FIG. 1. According to the embodiment shown in FIG. 4, the modified deflector 96 includes bases 98 and 100 which are horizontally oriented and which extend in opposite directions from each other. The deflector 96 further includes angled sections 102 and 104 and an upward standing shoulder 106 to define angled air channels which are mirror images of each other.

An I-beam 108 which includes a pair of back-to-back C-shaped channels 110 and 112 which open in opposite directions extends upwardly from the shoulder 106. The C-shaped channel 110 includes a top spacer seat 114 for receiving the leg 50 of the top spacer 46 and a bottom spacer seat 116 for receiving the leg 42 of the bottom spacer 38. In a similar manner, the C-shaped channel 112 includes a top spacer seat 118 for receiving the leg 50 of the top spacer 46 and a bottom spacer seat 120 for receiving the leg 42 of the bottom spacer 38.

It will be recognized by those of ordinary skill in the art that the various air deflectors 12 and 96 may be used interchangeably to effect a particular architectural or mechanical advantage.

In operation of the various embodiments of the present invention, air flows through an air passage indicated by the arrow A in FIGS. 1–4 along the length of the air bar 10. The air bar 10 may be adjusted to control the flow of air through the air passage. Specifically, and with reference to FIG. 2, if it is desired to have air flow on both sides of the pattern controller 52, the pattern controller 52 may be manually adjusted by laterally sliding it from the position shown in FIG. 2 adjacent the left hand deflector 12 toward the right hand deflector 12. The adjustment will partially open the air passage to the left of the pattern controller 52, thereby allowing air to flow through the air bar 10 on either side of the pattern controller 52 and exiting the air bar 10 through the air slot 18.

As shown in FIG. 2, when the pattern controller 52 is adjacent the left-hand deflector 12, air is prevented from passing between the left-hand deflector 12 and the left-hand bulbous portion 54. Under these circumstances, air flows through the air bar 10 between the right-hand deflector 12 and the right-hand bulbous portion 54 and is directed through the air slot 18. Manipulation of the pattern controller 52 between the left-hand and right-hand deflectors 12 allows directional control of the air flow through the air bar 10 into a room or structure. The direction of this air flow can be reversed by shifting the pattern controller 52 from a position adjacent to the left-hand deflector 12 to a position adjacent to the right-hand deflector 12. Accordingly, the volume of air flowing on either or both sides of the pattern controller 52 is controlled by slidably adjusting the pattern controller 52 to the left or right, as desired. It will be understood by those of ordinary skill in the art that the air flow through the embodiments shown in FIGS. 3 and 4 may be manipulated in a manner similar to that as discussed above in reference to FIG. 2.

The components of the air bars according to the present invention and as illustrated in FIGS. 1–6 are typically constructed of extruded aluminum and it will be appreciated that the air bars can be constructed to any desired dimensions and specifications for installation in an extended ceiling or plenum air handling system of substantially any design.

The air bar of the present invention is capable of being architecturally integrated with any system to be installed in a ceiling.

The air deflectors of the air bar of the present invention have a uniform thickness and the angled profile of the air deflectors provides for effective air movement.

The air bar of the present invention is reduced in weight and has a lower raw material cost compared to conventional air bars. Also, the air bar of the present invention has a single pattern controller which gives the air bar better structural characteristics and makes it easier to manufacture and install compared to conventional air bars.

The system of connection clips and the hanger clips associated with the air bar of the present invention allow for attachment of air bars in any orientation without welding and for extensive prefabrication.

The single pattern controller of the air bar of the present invention having a generally barbell shaped cross section has reduced friction and is easier to adjust after installation when compared to conventional air bars having nested pattern controllers.

One embodiment of the air bars of the present invention allows for installation wherein the flanges defining the air slot are not visible from below the air bar.

Another embodiment of the air bar of the present invention allows for a modification of the air deflectors so that the deflector supports a pair of parallel air bars.

The various air deflectors of the air bars of the present invention can be mixed and matched to satisfy different architectural and mechanical goals.

While the present invention has been described in detail and with reference to specific embodiments thereof, it will be apparent to one of ordinary skill in the art that various modifications can be made therein without departing from the spirit and scope of the invention and the appended claims are intended to cover all such modifications.

What is claimed is:

1. An air bar for mounting in an air distribution system, comprising:

a) elongated means for controlling the pattern of air distributed from said system, said pattern controlling means comprising a substantially planar web portion extending in a first direction and first and second outer flanges having a cylindrical cross-section;

b) means for supporting said pattern controlling means, said support means engaging said first and second outer flanges of said pattern controlling means and said pattern controlling means being movable with respect to said support means in a second direction perpendicular to said first direction; and c) air bar means for supporting said support means, said air bar means extending in said first direction substantially coextensive witch said pattern controlling means and defining an air outlet opening, said air bar means delimiting the range of movement of said pattern controlling means with respect to said support means.

2. An air bar according to claim 1, further comprising means for connecting a plurality of said air bars.

3. An air bar according to claim 1, further comprising hangering means slidably engaged with said air bar means for suspending said air bar means within said air distribution system.

4. An air bar according to claim 1, wherein said pattern controller means is barbell-shaped in cross section.

5. An air bar according to claim 1, wherein said air bar means comprises a pair of opposed air bar members, each air bar member comprising an opening for receiving means for interconnecting said air bar means.

6. An air bar according to claim 1, wherein said air bar means comprises a pair of opposed air bar members, each air bar member comprising:

means for retaining said support means, said retaining means extending in a third direction generally perpendicular to said first and second directions;

means for defining an air channel connected to said retaining means, said air channel means comprising a first portion extending generally in said third direction, a second portion extending generally at an obtuse angle to said first portion and a third portion extending generally at an obtuse angle to said second portion; and a base connected to said second and third portions and extending at an acute angle to said second portion and parallel to said third portion, said base comprising a flange extending perpendicular to said base and generally in said third direction.

7. An air bar according to claim 6, wherein said retaining means, said first portion and said second portion of said air channel means, said base and said flange thereof define an opening for receiving means for interconnecting said air bar means.

8. An air bar according to claim 1, wherein said air bar means comprises a pair of opposed air bar members, each air bar member comprising:

means for retaining said support means, said retaining means extending in a third direction generally perpendicular to said first and second directions; and means for defining an air channel connected to said retaining means, said air channel means comprising a first portion extending generally parallel to said retaining means in said third direction, a second portion extending generally at an obtuse angle to said first portion and a third portion extending generally at an obtuse angle to said second portion.

9. An air bar according to claim 1, wherein said air bar means comprises an air bar member comprising:

means for retaining said support means, said retaining means being disposed in a third direction generally perpendicular to said first and second directions and comprising a pair of C-shaped channels opening in opposite directions and defining right and left bottom support means seats and right and left top support means seats; and means for defining an air channel connected to said retaining means, said air channel means comprising a top portion extending generally in said third direction, first and second middle portions each extending at an obtuse angle to said top portion and generally at a right angle to each other, a first bottom portion connected and extending at an obtuse angle to said first middle portion and a second bottom portion connected and extending an obtuse angle to said second middle portion.

10. An air bar for mounting in an air distribution system, comprising:

a) a pair of oppositely-disposed, spaced air deflectors having facing air channels;

b) a pair of substantially horizontally-disposed spacers carried by said air deflectors in spaced relationship; and c) elongated pattern controller means slidably disposed between said spacers and comprising a substantially planar web portion extending in a transverse direction to said air deflectors and first and second outer bulbous flanges engaging said spacers, said pattern controller means extending substantially along the length of said air deflectors;

whereby air is directed between said air deflectors and at least one of said bulbous flanges of said pattern controller means along at least one of said air channels, responsive to slidable lateral manipulation of said pattern controller means between said spacers.

11. An air bar for mounting in an air distribution system, comprising:

a) first and second vertically extending air deflector means disposed in horizontally spaced, facing and substantially parallel relationship;

b) first and second spacer means disposed in vertically spaced, substantially parallel relationship and engaged with and extending horizontally between said first and second air deflector means; and c) pattern controlling means for controlling the flow of air through said air distribution system, said pattern controlling means comprising a substantially planar web portion and first and second outer bulbous flanges, said pattern controlling means extending substantially along the length of said air deflector means, said pattern controlling means being in sliding engagement with and movable with respect to said first and second spacer means, said first and second air deflector means delimiting the range of movement of said pattern controlling means with respect to said first and second spacer means.

12. An air bar for mounting in an air distribution system, comprising:

a) elongated means for controlling the pattern of air distributed from said system, said pattern controlling means extending in a first direction;

b) means for supporting said pattern controlling means, wherein said pattern controlling means are movable with respect to said support means in a second direction perpendicular to said first direction;

c) air bar means for supporting said support means, said air bar means extending in said first direction substantially coextensive with said pattern controlling means and defining an air outlet opening, said air bar means delimiting the range of movement of said pattern controlling means with respect to said support means; and d) hangering means slidably engaged with said air bar means for suspending said air bar means within said air distribution system.

13. A hanger for supporting an air bar having a C-shaped channel in an air distribution system in a structure, comprising:

a) first and second vertically extending air bar engaging means disposed in horizontally spaced, facing and substantially parallel relationship;

b) stem means having an orifice for attachment to a structure; and c) first and second connecting means extending at an angle greater than 90° but less than 270° with respect to each other, said connecting means connecting said first and second air bar engaging means to said stem means;

wherein said first and second air bar engaging means are adapted to engage and slide within said C-shaped channel disposed on an air bar.

* * * * *

UNITED STATES PATENT AND TRADEMARK OFFICE

CERTIFICATE OF CORRECTION

PATENT NO. : 5,433,662

DATED : July 18, 1995

INVENTOR(S) : John W. Hungerford

It is certified that error appears in the above-indentified patent and that said Letters Patent is hereby corrected as shown below:

Column 8, line 18, change "witch" to -- with --.

Column 9, line 20, after "extending" insert -- at --.

Signed and Sealed this

Tenth Day of October, 1995

*Attest:*

*Attesting Officer*

BRUCE LEHMAN

*Commissioner of Patents and Trademarks*